United States Patent [19]

Kanno et al.

[11] Patent Number: 4,976,883

[45] **Date of Patent: * Dec. 11, 1990**

[54] PROCESS FOR PREPARING A MAGNETIC FLUID

[75] Inventors: Takao Kanno, Tokyo; Yutaka Koda, Yokohama; Hirokazu Nagato, Fujisawa, all of Japan

[73] Assignee: Nok Corporation, Tokyo, Japan

[ * ] Notice: The portion of the term of this patent subsequent to Dec. 11, 2007 has been disclaimed.

[21] Appl. No.: 319,695

[22] Filed: Mar. 7, 1989

[30] Foreign Application Priority Data

Mar. 11, 1988 [JP] Japan ..... 63-56151

[51] Int. Cl.[5] ..... H01F 1/28

[52] U.S. Cl. ..... 252/62.52

[58] Field of Search ..... 252/62.54, 62.56, 62.51, 252/62.52; 106/460

[56] References Cited

U.S. PATENT DOCUMENTS

| | | | |
|---|---|---|---|
| Re. 32,573 | 1/1988 | Furumura et al. | 252/62.56 |
| 3,549,396 | 12/1970 | Dietz | 106/460 |
| 3,925,095 | 12/1975 | Bockmann et al. | 106/460 |
| 4,604,229 | 8/1986 | Raj et al. | 252/62.56 |
| 4,645,611 | 2/1987 | Campbell et al. | 252/62.54 |
| 4,687,596 | 8/1987 | Borduz et al. | 252/62.58 |
| 4,762,568 | 8/1988 | Nakamura et al. | 106/460 |

*Primary Examiner*—John Doll
*Assistant Examiner*—Stephen G. Kalinchak
*Attorney, Agent, or Firm*—Fred Philpitt

[57] ABSTRACT

A magnetic fluid containing fine particles of ferrite stably dispersed in a carrier liquid is prepared by adding carrier liquid and a dispersing agent selected from N-polyalkylenepolyamine-substituted alkenylsuccinimide, an oxyalkylene-substituted phosphoric acid ester and a nonionic surfactant, and, if required, hydrocarbon solvent having a low boiling point to particles of ferrite which is coated with water-soluble surfactant and subjecting the resulting mixture to a dispersion treatment and, if required, removal of the hydrocarbon solvent.

15 Claims, No Drawings

PROCESS FOR PREPARING A MAGNETIC FLUID

BACKGROUND OF THE INVENTION

1. Field Of The Invention

This invention relates to a process for preparing a magnetic fluid, and more particularly to a process for preparing a magnetic fluid having an improved saturation magnetization by stably dispersing fine particles of ferrite in a carrier liquid which vapor pressure is low at a high concentration.

2. Description Of The Prior Art

Fine particles of ferrite are prepared by pulverization, co-precipitation, vapor deposition, etc., among which co-precipitation procedure is usually used from the viewpoint of purity, particle size control, productivity, etc. However, co-precipitation is a precipitation reaction from an aqueous solution containing iron ions, and thus the resulting fine magnetic particles are in a suspended state in an aqueous solution.

On the other hand, it is desirable that fine particles of a magnetic material for a magnetic fluid are not in a coagulated state, but in an individually dispersed state. Thus, in case of fine particles of a magnetic material prepared by co-precipitation it is necessary to adsorb a surfactant for preventing a coagulation or agglomeration onto the surfaces of fine particles in a dispersed liquid state without passing through a drying step having a risk of coaguation and agglomeration of the fine particles themselves. Therefore, an aqueous surfactant is used.

A carrier liquid for a magnetic fluid containing dispersed fine particles which are coated with a aqueous surfactant is restricted to a relatively volatile solvent such as kerosine, toluene, etc., and when the magnetic fluid is used as a magnetic fluid seal, a magnetic fluid polishing, etc., evaporation of the carrier liquid is a problem so important as to deteriorate the function of the magnetic fluid itself.

Generally, a magnetic fluid is a dispersion of fine particles of ferrite in a carrier liquid by using a dispersing agent such as a higher fatty acid salt, sorbitan ester, etc. However, any high stability of dispersion cannot be obtained from a mere dispersion of fine particles of ferrite in a carrier liquid and such a dispersion is not used in practical applications.

Thus, the present inventors have previously proposed a process which comprises first dispersing fine particles of ferrite coated aqueous surfactant in a hydrocarbon solvent waving a low boiling point, then mixing the dispersion with a carrier liquid, and removing the hydrocarbon solvent therefrom by distillation under ultrasonic irradiation, thereby substituting the liquid carrier which is employed in ferrofluid (Japanese Patent Application Kokai (Laid-open) No. 63-3099).

SUMMARY OF THE INVENTION

A first object of the present invention is to provide a process for stably dispersing fine particles of ferrite which are coated with a aqueous surfactant directly into a high boiling point carrier liquid (low vapor pressure carrier liquid) without using the foregoing substitution process.

A second object of the present invention is to provide a process for stably dispersing fine particles of the ferrite into a carrier liquid, thereby obtaining a magnetic fluid having a higher saturation magnetization by using the hydrocarbon solvent simultaneously at the dispersion into a carrier liquid and then removing the hydrocarbon solvent therefrom.

DETAILED DESCRIPTION OF THE PREFERRED EMBODIMENTS

The first object of the present invention can be attained by adding a carrier liquid having a vapor pressure of not more than 0.1 mmHg at 25° C., and a dispersing agent selected from N-polyalkylenepolyamine-substituted alkenylsuccinimide, a phosphoric acid ester having a mono- or di-oxyalkylene substituent and a nonionic surfactant, to fine coated particles and then subjecting the mixture to a dispersion treatment.

The second object of the present invention can be attained by adding a carrier liquid having a vapor pressure of not more than 0.1 mmHg at 25° C. and a dispersing agent selected from N-polyalkylenepolyamine-substituted alkenylsuccinimide, a phosphoric acid ester having a mono- or di-oxyalkylene substituent and a nonionic surfactant, and a hydrocarbon solvent to fine coated particles, then subjecting the mixture to a dispersion treatment, and removing the hydrocarbon solvent therfrom.

Fine particles of ferrite can be used irrespective of their preparation procedures, but it is preferable from the viewpoint of purity, particle size control, and, above all, productivity to use fine particles of ferrite prepared by co-precipitation.

The surfactant to be adsorbed on the fine coated particles includes those usually used for dispersing fine particles into a hydrocarbon solvent, as given below, and preferably higher fatty acid salts and sorbitan esters are used.

Higher fatty acid salts such as sodium oleate, sodium erucate, etc.

Sorbitan esters such as polyoxyethylene sorbitan ester, etc.

Higher fatty acids such as oleic acid, stearic acid, etc.

Dialkylsulfosuccinates such as Aerosol-OT, etc.

Polyoxyethylene alkyl aryl ethers such as polyoxyethylene nonyl phenyl ether, etc.

Polyoxyethylen alkyl ethers such as polyoxyethylene lauryl ether, etc.

Polyoxyethylen alkyl ester

Alchohol sulfuric acid ester as dodecylsulfuric acid ester, etc.

Alkylbenzenesulfonic acid

Phosphates such as oleyl phosphate, etc.

Polyoxyethylene alkyl amine

Glycerine ester

Aminoalcohol ester

In the present process, water as an inhibiting factor for the dispersion into the carrier liquid is thoroughly removed from fine particles of ferrite which are coated with the water-soluble surfactant and having particle sizes of about 50 to about 300Å, preferably about 70 to about 120Å by drying, and then a carrier liquid and a dispersing agent are added thereto and the mixture is subjected to a dispersion treatment.

The carrier liquid includes liquid oils having a vapor pressure of not more than 0.1 mm Hg, preferably 0.01 mm Hg at 25° C., for example, natural oils such as white oil (liquid paraffin), mineral oil, spindle oil, etc. and synthetic oils such as higher alkylbenzene, higher alkylnaphthalene, polybutene(molecular weight: about 300-about 2,000), dicarboxylic acid diesters (such as dioctyl azelate, dioctyl adipate, dioctyl sebacate, dibutyl phthalate, dihexyl, maleate, etc.), polyolpolyesters of polyols with carboxylic acids having 6 to 10 carbon atoms (such as trimethylol propane tri-n-heptyl ester, pentaerythritol tetra-n-hexyl ester, pentaerythritol tetra-2-ethylhexyl ester, etc.), phosphoric acid triesters (such as phosphoric acid tributyl ester, phosphoric acid tri-2-ethylhexyl ester, phosphric acid tricresyl ester, etc.), and a lubricating oil containing so-called lubricating additives such as an antioxidant, an anti-attrition agent, an oiliness improver, a detergent dispersant, etc. They are used to make a concentration of fine particles of ferrite about 10 to about 50% by weight in the ultimate magnetic fluid.

The dispersing agent to be added in an amount of generally about 10 to about 50% by weight, preferably about 20 to about 40% by weight, to the fine particles of the ferrite include the following three types:

(1)N-polyalkylenepolyamine-substituted alkenylsuccinimide, represented by the following formulae:

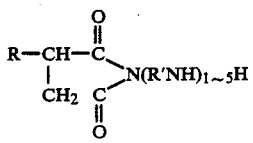

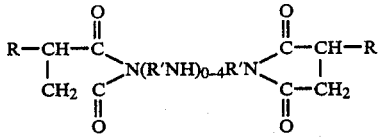

wherein R is a hydrocarbon group having 12 to 24 carbon atoms or a polybutenyl group having a molecular weight of about 300 to about 2,000 and R′ is an alkylene group having 1 to 6 carbon atoms and can be the same or different when at least two of R′ are repeated.

(2) Phosphoric acid esters having a mono- or di-alkylene group, represented by the following formulae, or their mixture:

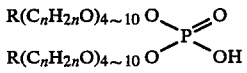

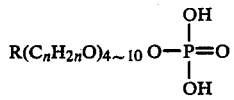

where R is an alkyl group having 6 to 18 carbon atoms or an alkylphenyl group having an alkyl group having 5 to 10 carbon atoms and n is 2 or 3.

(3) Nonionic surfactant including an ethylene oxide type such as polyoxyethylene alkylaryl ether, polyoxyethylene alkyl ether and polyoxyethylene alkyl ester; a sorbitan-fatty acid ester such as sorbitan-higher fatty acid mono(triester;

a polyoxyethylene sorbitan fatty acid ester type such as polyoxyethylene sorbitan-fatty acid mono(tri)ester; and a glycerin ester type such as glycerin-higher fatty acid mono(tri)ester.

After the addition of these carrier liquid and the dispersing agent, the dispersion treatment is carried out according to an ordinary procedure using a homogenizer, an ultrasonic irradiation, a ball mill, etc., whereby a magnetic fluid containing fine particles of the ferrite stably dispersed in the carrier liquid can be formed.

It has been found in the dispersion treatment after the addition of the carrier liquid and the dispersing agent that the diffusion efficiency can be increased by the presence of a hydrocarbon solvent and a magnetic fluid with an elevated saturation magnetization can be obtained by removing the hydrocarbon solvent therefrom.

The hydrocarbon solvent includes aliphatic, alicyclic and aromatic hydrocarbon solvents having a boiling point of about 50 to 150° C., such as n-hexane, n-heptane, n-octane, isooctane, n-decane, cyclohexane, toluene, xylene, mesytylene, ethylbenzene, petroleum ether, petroleum benzine, naphtha, ligroin, etc., at least one of which is used in an amount of about 1 to about 10 times the volume of the carrier liquid. After a dispersion treatment carried out in the same manner as above, these hydrocarbon solvents are removed therefrom usually by heating to about 70° to about 140° C. with stirring and, if required, by distillation under reduced pressure.

Fine particles of ferrite in a surfactant-coated state so that the fine particles themselves may not coagulate can be stably and directly dispersed in a carrier liquid by use of a specific dispersing agent according to the present process.

Furthermore, a magnetic fluid with a considerably higher saturation magnetization can be formed by making a hydrocarbon solvent present at the dispersion and removing the solvent therefrom, after the dispersion treatment, as is clear from the comparison of Example 1 with Example 7 or Example 4 with Example 8, which follow. The present invention will be described in detail below.

EXAMPLE 1

An aqueous 6N NaOH solution was added to 2,000 ml of an aqueous solution containing 185 g of $FeCl_2.4H_2O$ and 500 g of $FeCl_2.6H_2O$ with stirring until pH reached 11.0, and then the mixture was aged at 90° C. for 30 minutes. The thus obtained fine particles of magnetite were washed by decantation with desalted water several times and 70 g of sodium oleate and water were added thereto to make the total liquid volume 4,000 ml. Then, the mixture was stirred at 90° C. for 30 minutes. After cooling, 1N HCl was added thereto to make pH 6.0 and coagulated fine particles of magnetite were washed by decantation several times and dried.

Then, 3.0 g of the thus prepared fine particles of oleic acid-coated magnetite was admixed with 1.0 g of commercially available phosphoric acid mono- and dioxyalkylene ester mixture (GAFAC RE 610, made by Toho Kogaku K.K., Japan) and 3.0 g of alkylnaphthalene (Pump Oil-S; eicosylnaphthalene, a product of Lion K.K., Japan) as dispersing agents, and the resulting mixture was treated in a homogenizer at 10,000 rpm for one hour and then subjected to ultrasonic irradiation for 5 hours. Then, the mixture was subjected to centrifuge at 12,000 G for 30 minutes to remove the precipitates (1.5 g), whereby a magnetic fluid with a saturation magnetization of 180 G was obtained.

EXAMPLE 2

A magnetic fluid with a saturation magnetization of 150 G was obtained in the same manner as in Example 1, except that the same amount of pentaerythritol ester was used in place of the alkylnaphthlene. 1.6 g of the centrifuge precipitates was obtained.

EXAMPLE 3

In Example 2, the amount of pentaerythritol ester was changed to 4.0 g and the dispersion treatment was carried out in a ball mill for 2 hours. Then, precipitates (1.6 g) were removed by centrifuge, whereby a magnetic fluid with a saturation mangnetization of 120 G was obtained.

EXAMPLE 4

5.0 g of fine particles of oleic acid-coated magnetite was admixed with 1.5 g of polyoxyethylene nonylphenyl ether and 10 g of dioctyl sebacate, and the mixture was stirred in a homogenizer for one hour. Then, precipitates (3.1 g) were removed by centrifuge, whereby a magnetic fluid with a saturation magnetization of 90 G was obtained.

EXAMPLE 5

5.0 g of fine particles of oleic acid-coated magnetite was admixed with 1.5 g of polybutenylsuccinimide tetraethylenepentamine (PD-98A, a product made by Toho Kagaku K.K., Japan; molecular weight of polybutenyl group: about 1,300) and 5.0 g of alkylnaphthalene, and the mixture was treated in a ball mill for 24 hours. Then, the precipitates (2.8 g) were removed by centrifuge, whereby a magnetic fluid with a saturation magnetization of 150 G was obtained.

EXAMPLE 6

6.0 g of fine particles of oleic acid-coated magnetite was admixed with 2.0 g of polybutenylsuccinimide tetraethylenepentamine and 9.0 g of alkylnaphthalene, and the mixture was stirred in a homogenizer for one hour. Then, the precipitates (3.4 g) were removed by centrifuge, whereby a magnetic fluid with a saturation magnetization of 120 G was obtained.

COMPARATIVE EXAMPLE

When no dispersing agent was used at all in Example 1, almost all of the fine particles of magnetite were precipitated and separated from a clear from supernatant.

EXAMPLE 7

3.0 g of fine particles of oleic acid-coated mangnetite was admixed with 1.0 g of commercially available phosphoric acid mono- and di-oxyalkylene ester mixture (RE 610), 3.0 g of alkylnaphthalene and 15.0 g of toluene, and the mixture was subjected to stirring in a homogenizer for one hour and then to ultrasonic irradiation for 5 hours. Toluene was removed therefrom by distillation at 40° C. under reduced pressure with stirring, and the residues were centrifuged at 12,000 G to remove the precipitates (1.0 g), whereby a magnetic fluid with a saturation magnetization of 230 G was obtained.

EXAMPLE 8

5.0 g of fine particles of oleic acid-coated magnetite was admixed with 1.5 g of polyoxyethylene nonylphenyl ether and 10 g of dioctyl sebacate as dispersing agents and 20 g of n-octane, and the mixture was stirred in a homogenizer for one hour, and then n-octane was removed therefrom by distillation at 30° C. under reduced pressure with stirring. Then, the residues were centrifuged to removed the precipitates (2.5 g), whereby a magnetic fluid with a saturation magnetization of 120 G was obtained.

EXAMPLE 9

6.0 g of fine particles of oleic acid-coated magnetite was admixed with 2.0 g of polybutenylsuccinimide tetraethylenepentamine, 9.0 g of alkylnaphthalene and 15.0 g of isooctane, and the mixture was stirred in a homogenizer for one hour, and isooctane was removed therefrom by distillation at 110° C. under the atmospheric pressure with stirring. Then, the residues were centrifuged to remove the precipitates (2.7 g), whereby a magnetic fluid with a saturation magnetization of 150 G was obtained.

EXAMPLE 10

3.0 g of fine particles of oleic acid-coated magnetite was admixed with 1.0 g of commercially available phosphoric acid mono- and di-oxyalkylene ester mixture (RE 610), 4.0 g of pentaerythritol ester and 15.0 g of ligroin, and the mixture was treated in a ball mill for two hours. Then, ligroin was removed therefrom by distillation at 30° C. under reduced pressure with stirring and the residues were centrifuged to remove the precipitates (1.2 g), whereby a magnetic fluid with a saturation magnetization of 160 G was obtained.

What is claimed is:

1. A process for preparing a magnetic fluid containing fine particles of ferrite which comprises coating said particles with a water-soluble surfactant and thereafter dispersing said coated particles in a carrier liquid having a vapor pressure of not more than 0.1 mmHg at 25° C., said carrier liquid containing a dispersing agent selected from (a) a N-polyalkylenepolyamine-substituted alkenylsuccinimide, represented by the formulae

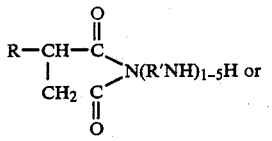

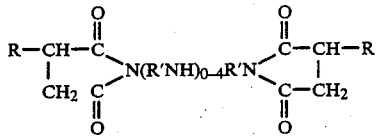

wherein R is a hydrocarbon group having 12 to 24 carbon atoms or a polybutenyl group having a molecular weight of about 300 to about 2,000 and R′ is an alkylene group having 1 to 6 carbon atoms and can be the same or different when at least two of R′ are repeated, and (b) a phosphoric acid ester having a di- or mono-oxyalkylene group, represented by the formulae

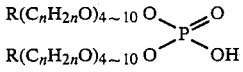

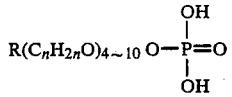

where R is an alkyl group having 6 to 18 carbon atoms or an alkylphenyl group having an alkyl group having 5 to 10 carbon atoms and n is 2 or 3.

2. A process according to claim 1 wherein said fine particles of ferrite have particle sizes of about 50 to about 300Å and are obtained by co-precipitation.

3. A process according to claim 1 wherein said carrier liquid is natural oil or synthetic oil.

4. A process according to claim 3 wherein said synthetic oil is an alkylbenzene, an alkylnaphthalene, polybutene, a dicarboxylic acid diester, a polyolpolyester, a phosphoric acid triester or a lubricating oil.

5. A process according to claim 1 wherein said carrier liquid is used in such an amount as to make a concentration of the particles of ferrite in a magnetic fluid about 10 to about 50% by weight.

6. A process according to claim 1 wherein about 10 to about 50% by weight of the dispersing agent is used on the basis of the fine particles of ferrite.

7. A process for preparing a magnetic fluid containing fine particles of ferrite which comprises coating said particles with a water-soluble surfactant and thereafter dispersing said coated particles in a carrier liquid having a vapor pressure of not more than 0.1 mmHg at 25° C., said carrier liquid containing a hydrocarbon solvent and a dispersing agent selected from (a) a N-polyalkylenepolyamine-substituted alkenylsuccinimide, represented by the formulae

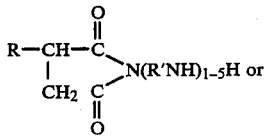

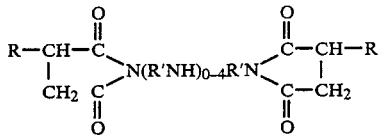

wherein R is a hydrocarbon group having 12 to 24 carbon atoms or a polybutenyl group having a molecular weight of about 300 to about 2,000 and R′ is an alkylene group having 1 to 6 carbon atoms and can be the same or different when at least two of R′ are repeated, and (b) a phosphoric acid ester having a di- or mono- oxyalkylene group, represented by the formulae

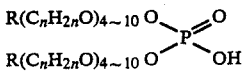

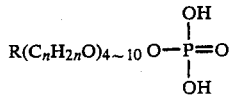

where R is an alkyl group having 6 to 18 carbon atoms or an alkylphenyl group having an alkyl group having 5 to 10 carbon atoms and n is 2 or 3, and hydrocarbon solvent having a boiling point of about 50° to about 150° C. to fine particles of ferrite which is coated with water-soluble surfactant, and then removing said hydrocarbon solvent after dispersion of said coated particles has been effected.

8. A process according to claim 7 wherein said particles of ferrite have particle sizes of about 50 to about 300Å and are obtained by co-precipitation.

9. A process according to claim 7 wherein said carrier liquid is natural oil or synthetic oil.

10. A process according to claim 9 wherein said synthetic oil is an alkylbenzene, an alkylnaphthalene, polybutene, a dicarboxylic acid diester, a polyolpolyester, a phosphoric acid triester or a lubricating oil.

11. A process according to claim 7 wherein said carrier liquid is used in such an amount as to make a concentration of the particles of ferrite in a magnetic fluid about 10 to about 50% by weight.

12. A process according to claim 7 wherein about 10 to about 50% by weight of said dispersing agent is used on the basis of the fine particles of ferrite.

13. A process according to claim 7 wherein said hydrocarbon solvent is used in an amount of about 1 to about 10 times the volume of said carrier liquid..

14. The process of claim 1 wherein said coated particles comprise oleic acid-coated magnetite.

15. The process of claim 7 wherein said coated particles comprise oleic acid-coated magnetite.

* * * * *